United States Patent [19]

Kosterka

[11] 4,410,560

[45] Oct. 18, 1983

[54] CONTINUOUS WEB PRINTING APPARATUS, PROCESS AND PRODUCT THEREOF

[75] Inventor: Donald W. Kosterka, Chicago, Ill.

[73] Assignee: Album Graphics, Inc., Chicago, Ill.

[21] Appl. No.: 309,923

[22] Filed: Oct. 9, 1981

[51] Int. Cl.[3] ..... B05D 3/06

[52] U.S. Cl. ..... 427/44; 250/492.3; 250/515.1; 250/517.1; 427/35

[58] Field of Search ..... 427/44, 43.1, 35, 36; 250/492.3, 515.1, 517.1

[56] References Cited

U.S. PATENT DOCUMENTS

| | | | |
|---|---|---|---|
| 2,956,904 | 10/1960 | Hendricks | 427/44 |
| 3,008,242 | 11/1961 | Sites et al. | 427/54.1 |
| 3,144,552 | 8/1964 | Schonberg et al. | 250/492.3 |
| 3,499,141 | 3/1970 | Kingsley et al. | 250/492.3 |
| 3,564,238 | 2/1971 | Martin et al. | 250/492.3 |
| 3,628,987 | 12/1971 | Nakata et al. | 427/44 |
| 3,669,720 | 6/1972 | Remer | 427/57 |
| 3,713,864 | 1/1973 | Ackerman et al. | 427/44 |
| 4,001,462 | 1/1977 | Blin et al. | 427/44 |
| 4,070,497 | 1/1978 | Wismer et al. | 427/44 |
| 4,246,297 | 1/1981 | Nablo et al. | 427/44 |
| 4,252,413 | 2/1981 | Nablo | 250/492.3 |
| 4,345,545 | 8/1982 | Miller | 427/44 |

FOREIGN PATENT DOCUMENTS 2101682 3/1972 France .

*Primary Examiner*—John H. Newsome
*Attorney, Agent, or Firm*—Evelyn M. Sommer

[57] ABSTRACT

A continuous web printing appartus and method employs a printing station for printing electron beam curable inks on a continuous web, a coating station for coating the printed web with an electron beam curable coating, and an electron beam curing unit for rapidly curing the inks and coating. The resulting print is of exceptionally high quality and may be processed at much higher rates and with lower operating costs than previously attainable with conventional radiation curing techniques.

5 Claims, 2 Drawing Figures

CONTINUOUS WEB PRINTING APPARATUS, PROCESS AND PRODUCT THEREOF

FIELD OF THE INVENTION

The present invention is directed to the field of web offset printing.

BACKGROUND OF THE INVENTION

Web offset printing utilizes a continuous web of paper upon which printing or pictorial indicia may be printed. Typically, the web, or roll of unprinted paper or plastic material, is dispensed from a roll stand and supplied to offset print stations which function to apply ink to the web in a predetermined pattern. The printed web is later provided to further processing apparatus which may variously function to rewind the web into a finished roll or to cut the web into sheets for folding or stacking. However, if the ink is not thoroughly dry, "set-off" or transfer of the ink to adjacent or overlying web material will occur. Thus, drying or curing of the ink is of paramount importance to the printing process.

In order to facilitate drying of the print, several techniques have been devised. For example, prior systems have employed hot air blowers and more recently infrared heaters to heat the printed web to hasten the drying process. A more modern technique of hastening the drying process is with an ultraviolet (UV) curing system which functions to expose the printed web to large amounts of ultraviolet radiation. Generally, these prior techniques are limited in drying or curing speed by temperature considerations and thus represent the time-limiting factor in continuous web printing. Further, the prior techniques require large amounts of energy thus increasing the cost of such systems.

While the UV curing systems are an improvement over the hot air blowers and infrared systems, the UV curing systems require specialized inks and coatings which tend to be expensive. Additionally, the UV curing technique is color sensitive, some colors curing more rapidly than others and the overall result is a relatively slow curing process. Further, certain UV inks do not perform well on certain webs or substrates. Variations in UV lamp life can also present problems, since as lamps become weaker, quality variations begin to appear.

The above-mentioned techniques for hastening the drying process of the ink all involve the transfer of a large amount of heat to the ink and webbing resulting in a deterioration of the webbing. Additionally, none of these techniques are rapid enough to cure extremely heavy layers of inks and coatings which may be desired for certain application.

Recently, new techniques for curing coatings, such as pressure sensitive adhesive coatings, or resin precursor coatings, employing electron beam radiation, have been devised. For example, U.S. Pat. No. 4,177,314 to Steeves teaches the use of a radiation curable resin for coating a paper substrate to provide a smooth resin film thereon. After applying the resin coating to the paper substrate, the coated substrate is immediately cured by exposing it to an electron beam "curtain" transverse to the movement of the substrate web. The electron beam machinery provides two to three megarads which is sufficient to cure the resin film within a few milliseconds of exposure to the beam. After curing the resin coating, standard printing may be applied to the smooth resin coating, the coating providing a smooth surface which absorbs very little of the ink applied thereon, yet which provides an improved surface for the adhesion of the ink thereto.

Another use of the electron beam curing technique is described by Nablo et al in U.S. Pat. No. 4,246,297, which describes the use of the electron beam curing technique for providing urethane or vinyl coatings on fabrics, or the provision of phenolic insulating coatings on wires. In particular, the patent to Nablo describes the curing of a coating layer formed on a substrate of either fabric or "release" paper. After curing, the release paper is separated from the coating.

SUMMARY OF THE INVENTION

It is therefore an object of the present invention to provide a continuous web printing apparatus, process and product thereof, which greatly increases processing speed and print quality, while at the same time drastically reducing operating costs.

It is a further object of the present invention to provide a continuous web printing technique which employs electron beam curing to greatly enhance print processing speed and print quality, while reducing operating costs.

It is a further object of the present invention to employ electron beam radiation curable inks and coatings in a continuous web printing apparatus provided with an electron beam curing unit.

In accordance with a first aspect of the invention, an apparatus for printing on a continuous web of material includes at least one printing station for receiving the continuous web of material for printing a radiation curable ink thereon. An electron beam curing unit receives the web from the printing station and directs an electron beam at the web to thereby rapidly cure the ink printed thereon. Means are provided for continuously transporting the continuous web through the printing station and the curing station to rapidly and continuously cure the ink on the web as the web is transported through the curing unit, thereby providing a high speed and high quality printing of the web. A coating station may be provided between the printing station and the curing station for providing a radiation curable coating on at least a portion of the web to thereby provide a high gloss, medium gloss, or matte finish thereon. The printing station may include a variable repeat capability to provide for flexible format operation.

The electron beam curing unit in accordance with the present invention may specifically include a pair of rollers displaced horizontally and vertically from each other, the web traveling over one of the rollers and under the other of the rollers such that the web is oriented at an angle with respect to horizontal between the rollers. The electron beam may be produced by a linear cathode accelerator between the rollers and oriented with respect to the web such that the electron beam passes through the web perpendicularly.

In accordance with a second aspect of the present invention, a process for continuously printing a continuous web of material includes the steps of continuously moving the web through a printing station and an electron beam curing unit, continuously printing a radiation curable ink on the web at the printing station as the web moves therethrough, and continuously exposing the web to an electron beam in the curing unit as the web moves therethrough to thereby rapidly and continuously cure the ink to provide a high speed and high quality printing of the web. The web may also be moved through a coating station located before the curing unit to coat the web with a radiation curable coating on at least a portion of the web to thereby provide a high gloss, medium gloss, or matte finish upon curing the coating.

These and other objects and aspects of the present invention will be more fully described with reference to the following drawings figures of which:

DETAILED DESCRIPTION OF THE INVENTION

Figure 1:
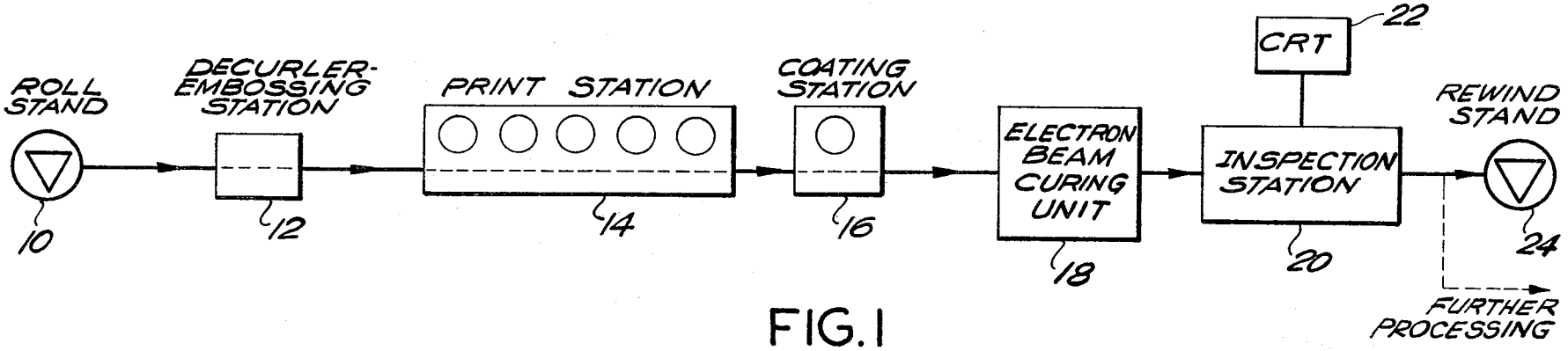
FIG. 1 is a block diagram illustrating the overall configuration of the continuous web printing apparatus and process in accordance with the present invention.

The continuous web printing apparatus illustrated in FIG. 1 is comprised of a roll stant 10 from which a web of paper or plastic material may be dispensed. Proceeding from the roll stand, the web travels through decurler and optional embossing station 12, and is applied to print station 14 where the electron beam curable inks, such as R80-6698, R80-6701, R80-6699 and R80-6700 (yellow, black, magenta and cyan, respectively,) by General Printing Ink Co., are applied to the web. Typically, the printing station apply the ink to the web using an offset printing process, usually printing in four to six colors. More particularly, the print station 14 may be comprised of the interchangeable cassette type cylinders which allow variable print cut-offs to suit the particular product line being printed, thus allowing the printing of variable size packages. For example, one such system, namely the Chambon Press TM system, provides the cassette cylinder system adapted for quick change-over. Plates for a subsequent job may be prepared while the present job is currently being run. Total press change-over with the cassette system may be accomplished in two hours, sometimes less.

From print station 14, the printed web is applied to coating station 16 where one or more radiation curable coatings, such as "EB Clear Topcoat" R226Z71, by PPG Industries, are applied to the printed web, or to selected portions thereof, to provide high or medium gloss finishes or a matte coating for the finished print. Additionally, the coatings may be provided as a size coating or prime coating, to thereby provide moisture resistance and/or rub resistance for the printed material.

The coating may be applied to the printed web using any one of the standard techniques such as roll coating, modified flexographic, offset gravure or reverse direct gravure.

The printed and coated web is then applied to the electron beam curing unit 18, such as RPC Industries linear cathode curing unit which may be of the same type described in the above-mentioned patents. While dose rates and electron energies are disclosed in the above mentioned patents and may be varied according to the desired treatment time, web speed, penetration depth and print and coating thickness and chemistry, it has been found that a dose of 1–2.8 Mrads, with an electron energy of approximately 225 KeV, with currents up to 270 mA, provide sufficient curing for printing speeds of up to 850 feet/min.

From the electron beam curing unit 18, the finished product is delivered to inspection station 20, which may employ a moving web color densitometer which analyzes ink laydown and reports its results to CRT 22. Although not shown, the printing apparatus may further include conventional electronic web scanning and tension control systems as well.

After inspection, the web may either be rewound on rewind stand 24, or may be delivered to downstream equipment such as an in-line die cutter, scoring device, sheeter, slitter, and the like, for further processing. The blanks produced by such downstream equipment may be automatically stacked and loaded onto a pallet.

Figure 2:
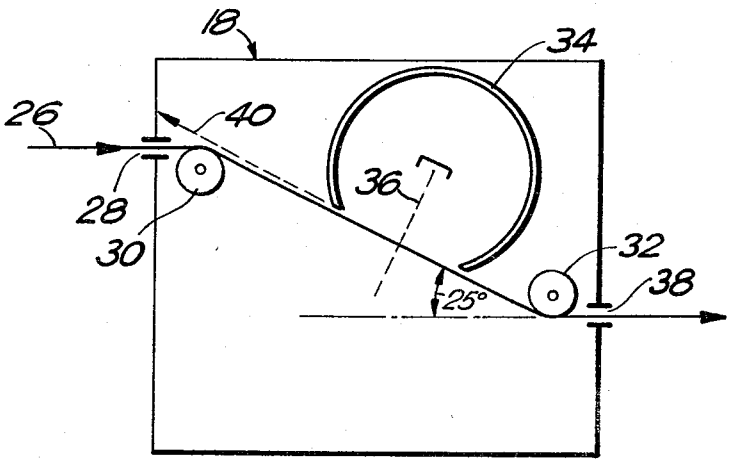
FIG. 2 is a diagram illustrating the contents of electron beam curing unit 18.

The details of the electron beam curing unit 18 will now be discussed with reference to FIG. 2. The printed and coated web 26 from coating station 16 enters curing unit 18 via input slot 28 where it comes into contact with first roller 30. Moving over first roller 30, web 26 moves diagonally downward to come into contact with a second roller 32, rollers 30 and 32 being positioned so as to provide an approximately 25° angle of travel with respect to horizontal for the web. Linear cathode accelerator 34, located between rollers 30 and 32, provides the above-mentioned electron beam and has its electron beam output port oriented substantially parallel to webbing 26 such that the electron beam passes through web 26 from a substantially perpendicular angle as illustrated by the dashed line 36. Web 26 is then delivered from roller 32 to inspection station 20, FIG. 1, via output slot 38.

Web 26 and linear cathode accelerator 34 are oriented at an approximately 25° angle in order to reduce radiation leakage from unit 18. If web 26 and the output port of accelerator 34 were to be located in the same horizontal plane, stray electron beam radiation could directly radiate from accelerator 34 substantially in that horizontal plane resulting in radiation leakage from ports 28 and 38. With the slanted configuration, any such stray radiation, as indicated by dashed line 40, will be blocked by the walls of unit 18.

The apparatus and method just described provides a remarkably high quality print at a very high printing speed, while at the same time requiring a small fraction (approximately 50% or less) of the electricity required by the ultraviolet technique, for example. Process rates of 850 feet per minute are readily achieved, thus providing more than a three-fold increase in web processing rates available in the techniques heretofore employed, since drying of the inks and coatings is no longer a time limiting factor. The electron beam cures the inks and coatings uniformly throughout the thickness of the printed material with no degradation of the substrate due to undue drying or heating thereof. Therefore, thicker inks and coatings can easily be employed while at the same time increasing rub resistance and set-off resistance.

Additionally, the inks which may be used in conjunction with the electron beam curing process are cheaper than UV curable inks, thereby further reducing operating costs. A wider variety of radiation curable inks are available as opposed to UV curable inks, thereby providing better color versatility. The electron beam curing process is also "color blind," whereby each of the inks and coatings are cured at substantially the same rate, as opposed to the UV curing techniques which are sensitive to pigment density.

The end product of the continuous printing technique described above provides extremely high quality offset printing with high gloss coatings. Ink adhesion as well as overall appearance are superior to the prior art techniques.

The present technique readily lends itself to the printing of high quality decorative paper bags useful as shopping bags, sleeves for record jackets, gift wrap, book covers, and packaging for gifts and food. Paperboard may be employed to provide record album covers and folding cartons. Plastic, as well as paper, may be used as the web material to provide decorative plastic bags, displays, folding cartons and container lids. Clearly, many other uses of printed material using the techniques of the present invention will become apparent to those skilled in the art.

By providing a relatively thick, high gloss coating cure in accordance with the present invention, the packaging may provide a high degree of moisture and abrasion protection greater than that available by any of the other prior techniques.

While the preferred embodiments have been described in the specification and drawings, the scope of the invention will be defined with reference to the following claims.

What is claimed is:

1. An apparatus for printing on a continuous web of material, comprising:

at least one printing station for receiving a continuous web of material for printing a radiation curable ink thereon to provide an uncured, printed, continuous web;

an electron beam curing unit for receiving said uncured, printed, continuous web for providing an electron beam directed at said continuous web to thereby rapidly cure said ink printed thereon, said electron beam curing unit including an enclosure having an input slot and an output port which are vertically displaced relative to each other, with first and second rollers displaced horizontally and vertically from each other and respectively disposed adjacent said input slot and output port, said web entering said enclosure through said input slot and around said first and second rollers and thence out the output port such that the web is oriented within the electron beam curing unit at an angle to the horizontal between said first and second rollers, said curing unit further including a linear cathode accelerator between said first and second rollers for providing an electron beam, said accelerator oriented with respect to said web such that said beam passes through said web substantially perpendicularly so as to reduce radiation leakage from the curing unit; and means for continuously transporting said continuous web through said at least one printing station and said curing unit, whereby said ink is rapidly and continuously cured along said web as said web is transported through said curing unit to provide a high speed and high quality printing of said web.

2. The apparatus of claim 1 further providing a coating station between said at least one printing station and said curing unit for providing a radiation curable coating on at least a portion of said uncured, printed, continuous web, wherein said curing unit rapidly cures said ink and said coating on said web to provide a high gloss, medium gloss or matte finish thereon.

3. The apparatus of claim 1 wherein said at least one printing station comprises a variable repeat capability.

4. A process for continuously printing a continuous web of material at a high rate of speed and with minimum radiation leakage to the atmosphere, comprising:

continuously moving said web through a printing station and an electron beam curing unit, said electron beam curing unit including an enclosure having an input slot and output port which are vertically displaced relative to each other, with first and second rollers displaced horizontally and vertically from each other and respectively disposed adjacent said input slot and output port, said web entering said enclosure through said input slot and around said first and second rollers and thence out the outport port such that the web is oriented within the electron beam curing unit at an angle to the horizontal between said first and second rollers, said curing unit further including a linear cathode accelerator between said first and second rollers for providing an electron beam, said accelerator oriented with respect to said web such that said beam passes through said web substantially perpendicularly so as to reduce radiation leakage from the curing unit;

continuously printing a radiation curable ink on said web at said printing station as said web moves therethrough; and continuously exposing the angled portion of said web to an electron beam within said curing unit as said web moves therethrough to thereby rapidly and continuously cure said ink to provide a high speed and high quality printing of said web.

5. The process of claim 4 further comprising continuously moving said web through a coating station located before said curing unit, and coating said web in said coating station with a radiation curable coating on at least a portion of said web, wherein said curing unit rapidly cures said ink and said coating on said web to provide a high gloss medium gloss or matte finish thereon.

* * * * *